US007439694B2

(12) United States Patent
Atlas et al.

(10) Patent No.: US 7,439,694 B2
(45) Date of Patent: Oct. 21, 2008

(54) ADJUSTABLE LECTERN SYSTEM

(76) Inventors: Richard B. Atlas, 6020 Highway 55, Golden Valley, MN (US) 55422; Oleh M. Artym, 6020 Highway 55, Golden Valley, MN (US) 55422

( * ) Notice: Subject to any disclaimer, the term of this patent is extended or adjusted under 35 U.S.C. 154(b) by 0 days.

(21) Appl. No.: 11/465,766

(22) Filed: Aug. 18, 2006

(65) Prior Publication Data

US 2008/0043386 A1 Feb. 21, 2008

Related U.S. Application Data

(60) Provisional application No. 60/596,133, filed on Sep. 1, 2005.

(51) Int. Cl.
*H02P 1/00* (2006.01)
*G06F 1/16* (2006.01)
*A47B 17/00* (2006.01)

(52) U.S. Cl. ..... 318/280; 318/286; 318/560; 312/223.3; 312/312; 108/146; 108/147

(58) Field of Classification Search ..... 318/280, 318/283; D6/419, 511; 221/155; 108/44, 108/143; 312/223.3; 361/683, 695; 248/455; 381/75, 76

See application file for complete search history.

(56) References Cited

U.S. PATENT DOCUMENTS 2,830,118 A * 4/1958 Kohler ..... 381/76
3,023,274 A * 2/1962 Shaw ..... 381/75
4,065,194 A 12/1977 Mattia
5,087,010 A * 2/1992 Walters ..... 248/455
5,271,669 A * 12/1993 Pearlson ..... 312/7.2
5,322,025 A * 6/1994 Sherman et al. ..... 108/147
5,806,943 A * 9/1998 Dell et al. ..... 312/223.3
5,870,647 A * 2/1999 Nada et al. ..... 399/18
5,927,213 A * 7/1999 Leday ..... 108/96
6,435,109 B1 * 8/2002 Dell et al. ..... 108/144.11
6,874,431 B1 * 4/2005 Danna ..... 108/143
7,106,014 B1 * 9/2006 Mastalir et al. ..... 318/280
7,130,190 B1 * 10/2006 Baker ..... 361/695
7,277,273 B2 * 10/2007 Smith et al. ..... 361/679
2005/0056194 A1 * 3/2005 Danna ..... 108/143
2005/0275322 A1 * 12/2005 Mosel et al. ..... 312/312

* cited by examiner

*Primary Examiner*—Paul Ip
(74) *Attorney, Agent, or Firm*—Knoble, Yoshida & Dunleavy, LLC

(57) ABSTRACT

An adjustable lectern includes a base portion having a tubular upstanding base member and a tubular upstanding tower member that is mounted in a telescoping arrangement with respect to the base member. The base member and the tower member are each respectively formed as rigid tubes or channels by a single, unitary piece of material such as sheet metal. The lectern further includes a work platform that is positioned at an upper end of the tower portion. The work platform is both vertically and horizontally adjustable with respect to the base portion, so that both users who will be standing behind the lectern making a presentation and users who will be sitting behind the adjustable lectern in a wheelchair when making a presentation may be accommodated. Both the work platform and the base member include industry-standard rackmount structure for facilitating integration of electronic components.

21 Claims, 12 Drawing Sheets

ADJUSTABLE LECTERN SYSTEM

This application claims priority under 35 USC § 119(e) to Provisional Patent Application No. 60/596,133, filed Sep. 1, 2005, the entire disclosure of which is hereby incorporated by reference as if fully set forth herein.

BACKGROUND OF THE INVENTION

1. Field of the Invention

This invention relates to systems for facilitating presentations to an audience. More specifically, this invention relates to an improved adjustable lectern that is configured to permit either a disabled person in a wheelchair or a person who is standing to effectively make a presentation to an audience.

2. Description of the Related Technology

A lectern, which is sometimes alternatively referred to as a pulpit or podium, may be described as a furnishing that is designed to be used by a person who is making a presentation to an audience. Lecterns are common in auditoriums, classrooms, courtrooms, places of worship and other traditional public venues. Typically a lectern will have a reading surface on which notes may be placed, a reading lamp and a microphone holder. In elaborate settings such as boardrooms, courtrooms or conference centers the lectern will typically be styled so as to aesthetically match the decor of the surrounding room. It is important that the lectern be aesthetically pleasing because the audience's attention will be focused on the lectern and the speaker during a presentation.

A conventional lectern is configured to accommodate a person of average height who will be standing in front of an audience when delivering a presentation to an audience. While a conventional lectern may possess some amount of vertical adjustability, it is unable to accommodate a person who needs or prefers to sit while making a presentation. Accordingly, conventional lecterns have little utility for disabled individuals who are confined to a wheelchair and unable to stand. As a result, disabled individuals are frequently forced to sit at a standard height table when making a presentation to an audience. This places the disabled individual at a aesthetic disadvantage with respect to presenters who are capable of using the lectern. In addition, a disabled individual sitting at a table is denied the accessories and attendant functional capabilities that are ordinarily provided by the lectern, such as an effective reading lamp, proper adjustable microphone holder, timing device or clock and so forth.

A need exists for a lectern system that is accessible to the disabled and that is preferably stable in use, lightweight, aesthetically pleasing and inexpensive to produce.

SUMMARY OF THE INVENTION

Accordingly, it is an object of the invention to provide a lectern system that is accessible to the disabled and that is preferably stable in use, lightweight, aesthetically pleasing and inexpensive to produce.

In order to achieve the above and other objects of the invention, an adjustable lectern that is constructed according to a first aspect of the invention includes a base portion having a tubular upstanding base member having at least a front base surface, a first side base surface and a second side base surface; a tower portion that includes a tubular upstanding tower member that is mounted in a telescoping arrangement with respect to the tubular upstanding base member, the tubular upstanding tower member having at least a front tower surface, a first side tower surface and a second side tower surface; at least one bearing for enabling relative movement between the base portion and the tower portion; a motorized drive system for adjusting a vertical position of the tower portion relative to the base portion; a work platform that is positioned at an upper end of the tower portion; and wherein the base portion, tower portion, bearing and motorized drive system are configured so as to permit a vertical adjustment of the work platform that is sufficient to accommodate both users standing behind the adjustable lectern and users who are sitting behind the adjustable lectern in a wheelchair.

According to a second aspect of the invention, an adjustable lectern includes a base portion that has a tubular upstanding base member with a front base surface, a first side base surface and a second side base surface, the front base surface, first side base surface and second side base surface all being defined by a first single, unitary piece of material, the base member further having an opening defined in a rear side thereof, and wherein an electronics rackmount that is of an industry-standard configuration is provided adjacent to the opening; a tower portion that includes a tubular upstanding tower member that is mounted in a telescoping arrangement with respect to the tubular upstanding base member, the tubular upstanding tower member having at least a front tower surface, a first side tower surface, a rear tower surface and a second side tower surface, the front tower surface, first side tower surface, rear tower surface and second side tower surface all being defined by a second single, unitary piece of material; an electronic component mounted to the electronics rackmount, the electronic component extending into a hollow space within the tubular upstanding base member; a height adjustment drive system for adjusting a vertical position of the tower portion relative to the base portion; a work platform, the work platform being positioned at an upper end of the tower portion; and wherein the base portion, tower portion and height adjustment drive system are configured so as to permit a vertical adjustment of the work platform that is sufficient to accommodate both users standing behind the adjustable lectern and users who are sitting behind the adjustable lectern in a wheelchair.

An adjustable lectern according to a third aspect of the invention includes a base portion that includes a tubular upstanding base member; a tower portion that includes a tubular upstanding tower member that is mounted in a telescoping arrangement with respect to the tubular upstanding base member; a height adjustment drive system for adjusting a vertical position of said tower portion relative to the base portion; a work platform that is positioned at an upper end of the tower portion and has at least one opening defined in a top surface thereof, and wherein an electronics rackmount that is of an industry-standard configuration is provided on the top surface; an electronic component mounted to the electronics rackmount; and wherein the base portion, tower portion, and height adjustment drive system are configured so as to permit a vertical adjustment of the work platform that is sufficient to accommodate both users standing behind the adjustable lectern and users who are sitting behind the adjustable lectern in a wheelchair.

According to a fourth aspect of the invention, an adjustable lectern includes a base portion; a work platform; a height adjustment system for permitting adjustment of a vertical position of the work platform relative to the base portion; a horizontal adjustment system for permitting adjustment of a horizontal position of the work platform relative to the base portion; and wherein the work platform, the height adjustment system and the horizontal adjustment system are configured so as to permit positional adjustment of the work platform that is sufficient to accommodate both users standing behind the adjustable lectern and users who are sitting behind the adjustable lectern in a wheelchair.

An adjustable lectern that is constructed according to a fifth aspect of the invention includes a base portion; a tower portion that is vertically adjustable with respect to the base portion; a work platform that is mounted at an upper end of the tower portion, the work platform having an industry-standard electronics rackmount provided therein; and an electronic component mounted to the electronics rackmount.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
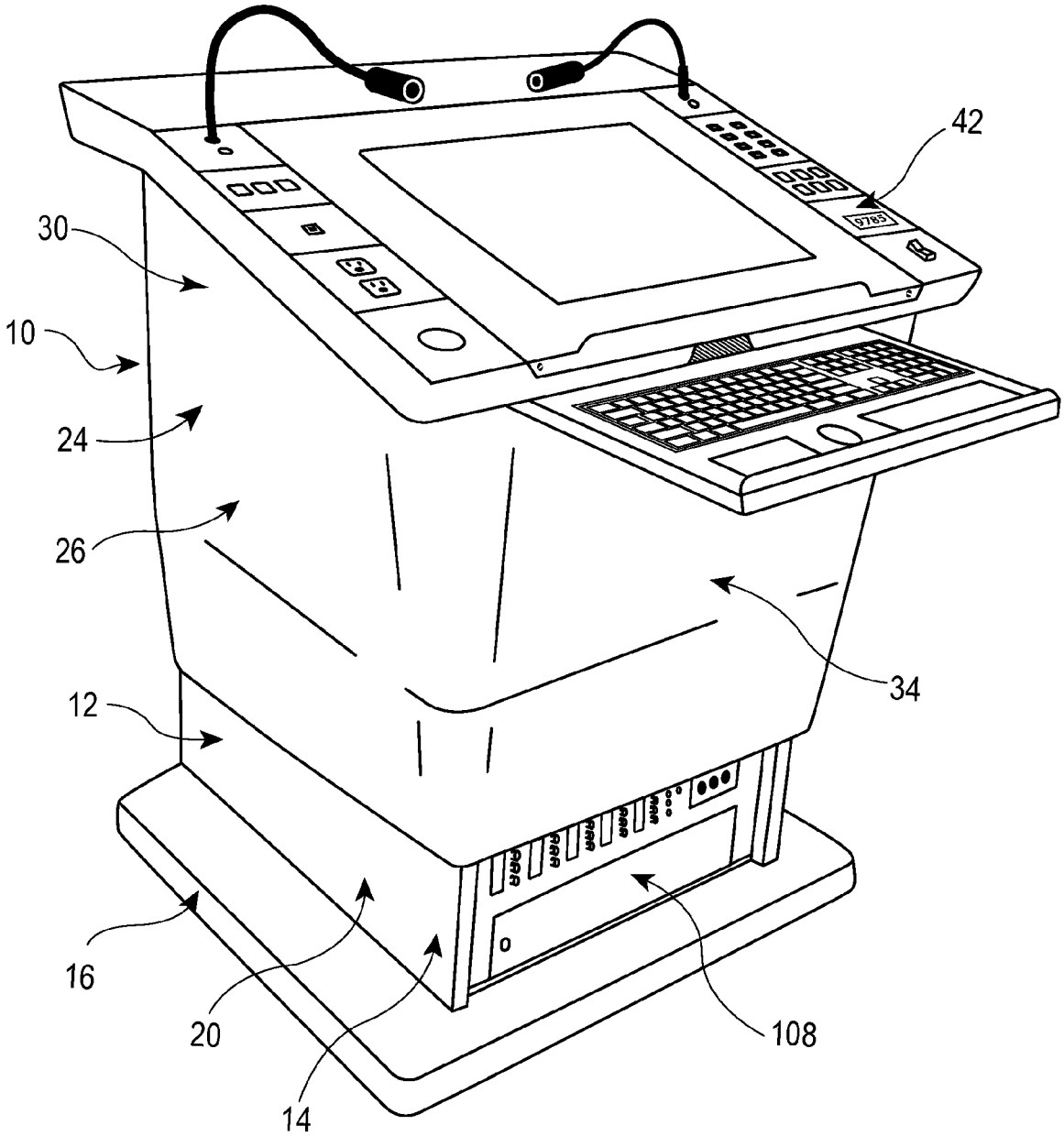
FIG. 1 is a perspective view of a lectern system that is constructed according to a preferred embodiment of the invention.

Referring now to the drawings, wherein like reference numerals designate corresponding structure throughout the views, and referring in particular to FIG. 1, an adjustable lectern 10 that is constructed according to a preferred embodiment of the invention includes a base portion 12 that is fabricated from a tubular upstanding base member 14. The tubular upstanding base member 14 is preferably fabricated from a single unitary piece of material, which in the preferred embodiment is sheet metal. Adjustable lectern 10 further includes a pedestal 16 that is attached to a lower end of the tubular upstanding base member 14 and is adapted for resting on a horizontal surface, such as a floor or platform. Decorative panels may be attached to pedestal 16 in order to aesthetically customize the appearance of adjustable lectern 10 to a particular setting or environment.

Figure 2:
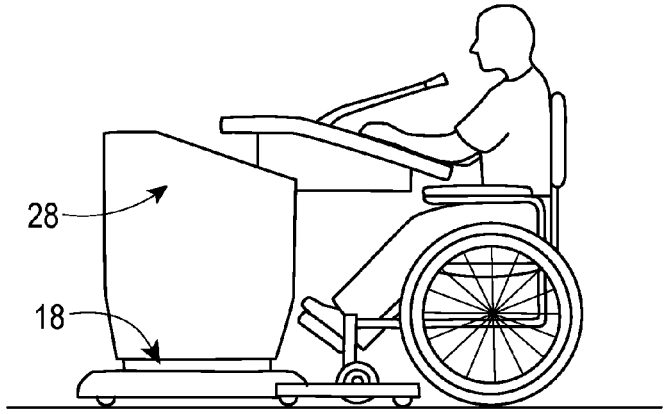
FIG. 2 is a diagrammatical view depicting the lectern system of FIG. 1 in a first configuration.
Figure 3:
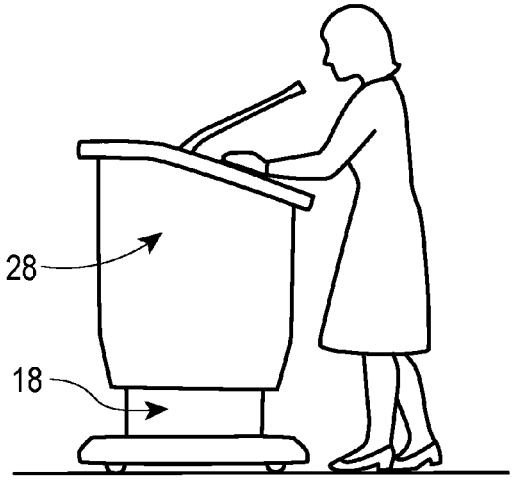
FIG. 3 is a diagrammatical view depicting the lectern system of FIG. 1 in a second configuration.
Figure 4:
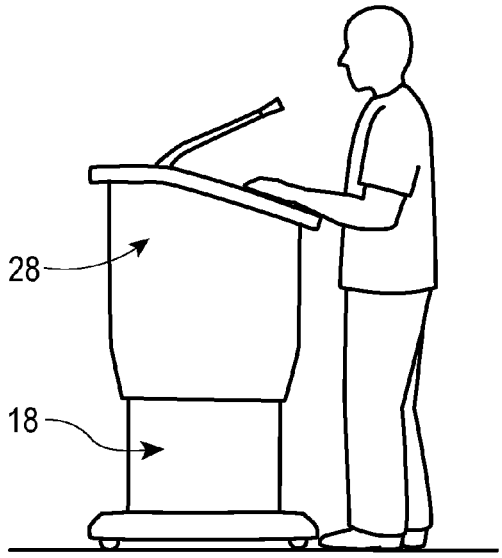
FIG. 4 is a diagrammatical view depicting the lectern system of FIG. 1 in a third configuration.
Figure 5:
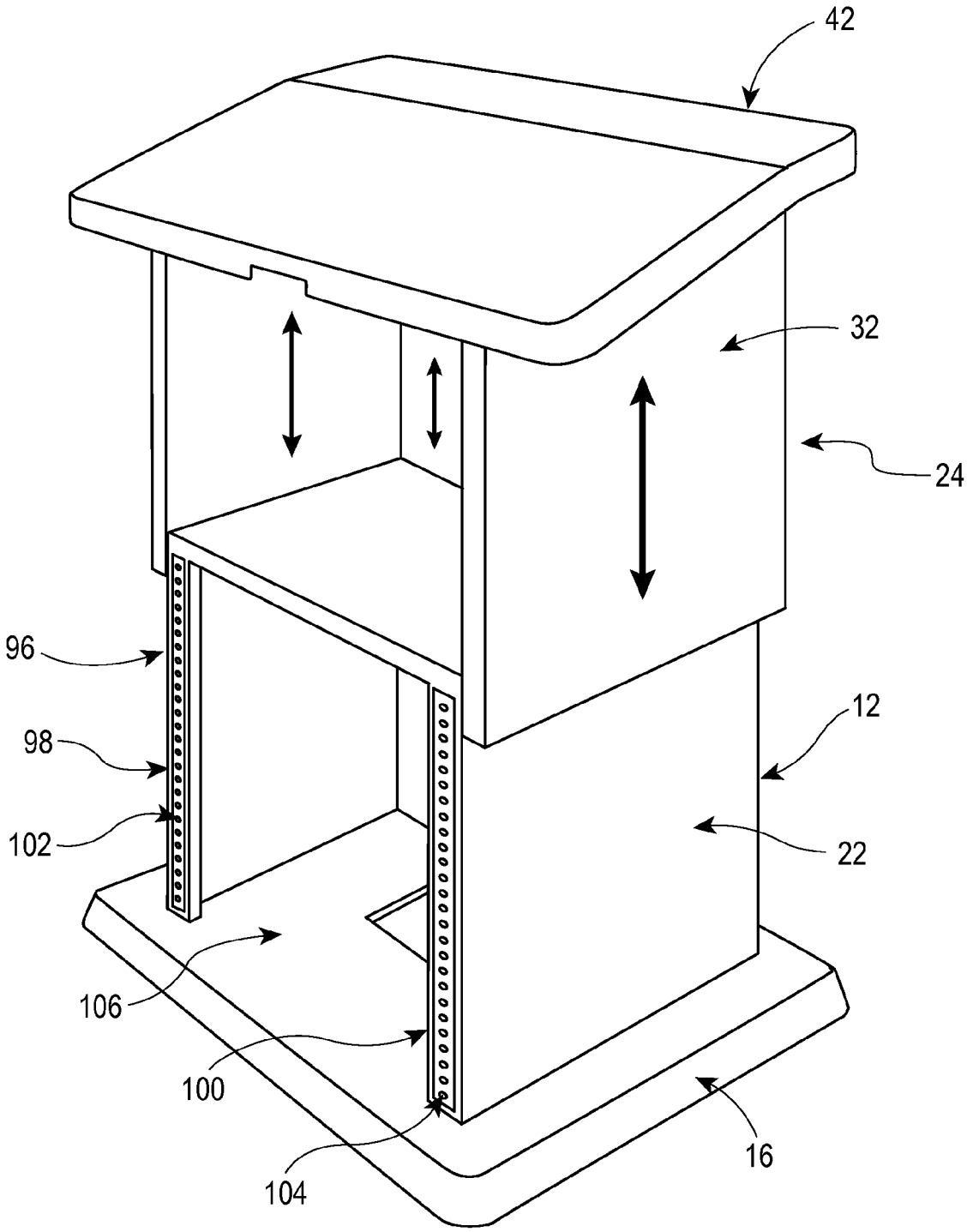
FIG. 5 is a rear perspective view of a portion of the lectern system that is shown in FIG. 1.

The tubular upstanding base member 14 preferably defines a front base surface 18, shown in FIGS. 2-4, that is intended to face an audience to which a presentation is being made, a first side base surface 20 that is shown in FIG. 1 and a second side base surface 22 that is best viewed in FIG. 5. The rear side of the tubular upstanding base member 14 is open in the preferred embodiment, as is shown in FIG. 5, for reasons that will be discussed in greater detail below.

Figure 6:
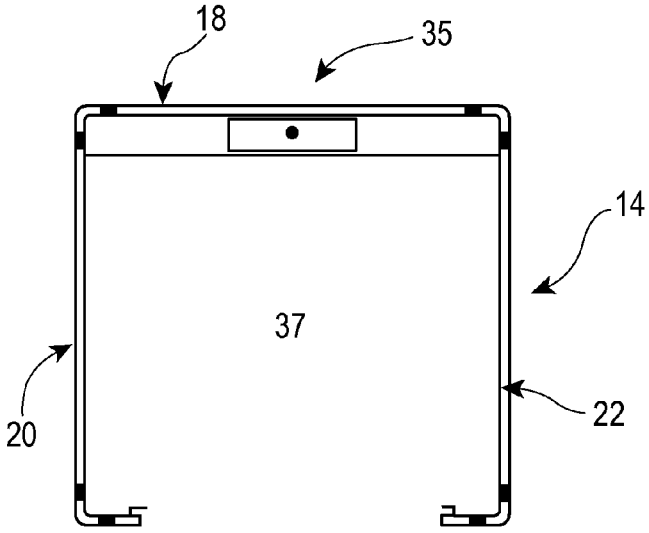
FIG. 6 is a horizontal cross-sectional view through a portion of the lectern system that is shown in FIG. 1.

The tubular upstanding base member 14 is accordingly preferably configured as a stiff, three sided tube or channel defined by the relatively thin material from which it is fabricated and that is generally U-shaped in horizontal cross-section, as is shown in FIG. 6.

The adjustable lectern 10 further preferably includes a tower portion 24 having a tubular upstanding tower member 26 that is mounted in a telescoping arrangement with respect to the tubular upstanding base member 14. The tubular upstanding tower number 26 is preferably fabricated from a single unitary piece of material, which in the preferred embodiment is sheet metal. It preferably defines a front tower surface 28, best viewed in FIGS. 2-4, that generally faces in the same direction as the front surface 18 of the tubular upstanding base member 14, a first side tower surface 30 as is shown in FIG. 1, a second side tower surface 32 as may be seen in FIG. 5 and a rear surface 34, viewable in FIG. 1, that is generally oriented to face a person who is making a presentation using the adjustable lectern 10. The tubular upstanding tower member 26 is accordingly configured as a stiff box channel that is defined by the relatively thin material from which it is fabricated. The tower member 26 and the base member 14 are both preferably formed of sheet steel which is powder coated, but also can be clad with any number of different wood or polycarbonate surfaces to match a preferred interior decor.

The main body portion of the adjustable lectern 10 that is formed by the tubular upstanding base member 14 and the tubular upstanding tower member 26 may be described as being formed of an exoskeleton or a semi-monocoque. In other words, it is a tubular-like base and a tubular-like tower with closely guided bearings to prevent looseness and to provide superior stability and sturdiness with a framed internal structure.

Referring now to FIG. 6, it will be seen that the adjustable lectern 10 includes a drive system 35 for effecting vertical adjustment of the tubular upstanding tower member 26 with respect to the tubular upstanding base member 14. Drive system 35 is preferably powered by an electric motor, as will be discussed in greater detail below, and in the preferred embodiment includes a rotatable drive screw 37 mounted to the tubular upstanding base member 14 that engages a mating drive nut that is secured to the tubular upstanding tower member 26. Any number of alternative drive mechanisms could alternatively be used within the spirit of the invention. In addition, the drive system 35 can be configured so that it is powered manually, rather than by an electric motor. Drive system 35 could also be configured so that it is ordinarily powered using the electric motor, but that provision is made for manual adjustment as well in the event of a malfunction of the power drive system 35.

Figure 7:
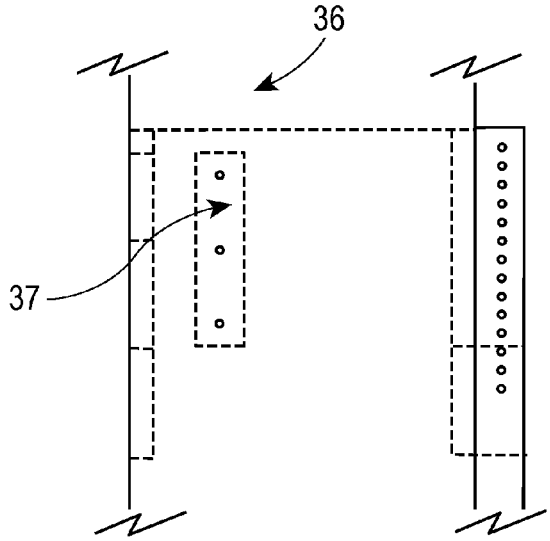
FIG. 7 is a diagrammatical view showing a portion of the lectern system that is shown in FIG. 1.

Bearing structure 36 is preferably provided between the tubular upstanding base member 14 and the tubular upstanding tower member 26 in order to smoothly guide upward and downward movement of the tubular upstanding tower member 26 with respect to the tubular upstanding base member 14 when the height of the adjustable lectern 10 is adjusted. In the preferred embodiment that is depicted in FIG. 7, bearing structure 36 is configured as a plurality of slide bearing members or shoes 37 that are preferably secured to the outer surface of the tubular upstanding base member 14 and are positioned in the interstitial space between the outer surface of the tubular upstanding base member 14 and the inner surface of the tubular upstanding tower member 26. Shoes 37 are preferably fabricated from a durable polymeric material that has a low frictional coefficient, such as PTFE, also known by the trademark TEFLON or the material that is known by the trademark DURALON.

Figure 8:
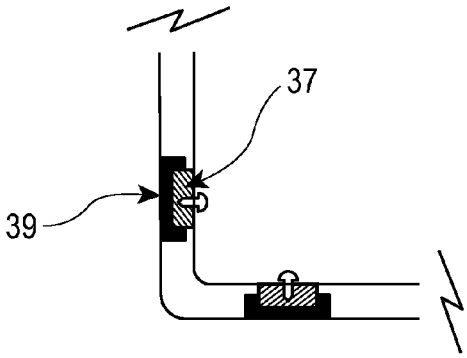
FIG. 8 is a fragmentary cross-sectional view depicting an alternative construction of the portion of the lectern system that is shown in FIG. 7.

FIG. 8 depicts a modified bearing arrangement in which a plurality of guide key ways are positioned in a vertical orientation and secured to the inner surface of the tubular upstanding tower member 26 so as to provide lateral guidance and a low friction engagement surface for the corresponding shoes 37.

Adjustable lectern 10 additionally includes a work platform 42 that provides a surface for resting notes, papers and other objects and that optionally includes a plurality of electronic interface devices and tools for a person who is making a presentation, as will be discussed in greater detail below. The base portion 12, the tower portion 24, the bearings 36 and an adjustment drive mechanism that will be described in greater detail below are configured so as to permit vertical adjustment of the work platform 42 within a range that is sufficient to accommodate both users who will be standing behind the adjustable lectern 10 and users who will be sitting behind the adjustable lectern 10 in a wheelchair or other chair.

In FIG. 3 and in FIG. 4, the adjustable lectern 10 is configured to accommodate a person who is making a presentation while standing. FIG. 3 depicts the adjustable lectern 10 at a height adjustment that is appropriate for a person of average height, while FIG. 4 shows the lectern 10 at a height adjustment that is appropriate for a taller individual.

Work platform 42 is also preferably mounted so as to be movable horizontally along a front to rear axis toward a person who is making a presentation, as may be visualized by comparing FIG. 2 with FIG. 3. This permits the top work surface to be easily horizontally extended to a wheelchair user's lap for ADA compliance in order to accommodate notes, a laptop computer or other devices. In FIG. 2, a person is shown making a presentation using the adjustable lectern 10 while seated in a wheelchair. In this configuration, the adjustable lectern 10 is adjusted to a vertical height that is less than the vertical height to which it is adjusted in either FIG. 3 or FIG. 4, and the work platform 42 has been moved horizontally to a rearwardmost position toward the person sitting in a wheelchair so that the person sitting in the wheelchair will have convenient access to the work platform 42 even though his or her feet preclude the person from positioning his or her torso as close to the tower portion 24 as a person who is standing making a presentation as shown in FIG. 3 or FIG. 4.

In order to permit horizontal movement of the work platform 42 from front to rear, the work platform 42 is preferably mounted on a pair of slide bearings relative to the upper portion of the tubular upstanding tower member 26. A locking system is also preferably provided to permit a user to lock the work platform 42 in a chosen horizontal position along the front to rear axis. Movement of the work platform 42 from front to rear is preferably effected manually, but could alternatively be accomplished by using a motorized drive mechanism.

Figure 9:
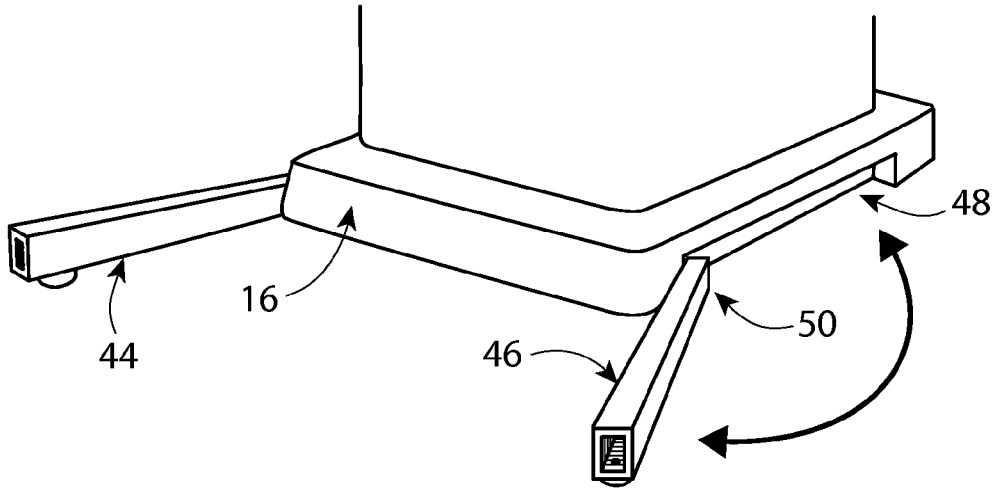
FIG. 9 is a diagrammatical cross-sectional view depicting another portion of the lectern system that is shown in FIG. 1.

When the adjustable lectern 10 is intended to be immovably positioned in a single location, it may conveniently be secured to an underlying support surface such as a floor by bolts, brackets or other suitable connectors. However, in many applications, it will be desired to retain the capability of moving the adjustable lectern 10 between different locations. As can be visualized by viewing FIG. 2, positioning the work platform 42 in the rearward position substantially shifts the center of mass of the adjustable lectern 10 to the rear. This might cause the adjustable lectern 10 to have a tendency to tip in the clockwise direction as viewed in FIG. 2 when the adjustable lectern 10 is not secured to an underlying surface, particularly since the adjustable lectern 10 is fabricated so as to have a lightweight construction. The tendency to tip in this direction would be exacerbated if the person who is making the presentation would intentionally or inadvertently press downwardly on the portion of the work platform 42 that is cantilevered outwardly toward the person who is making the presentation. In order to preclude the possibility of such tipping, the adjustable lectern 10 is advantageously provided with a pair of movable deployable outrigger support members 44, 46, which are best shown in FIG. 9. Each of the outrigger support members 44, 46 is preferably constructed as an elongated channel member that is mounted to a side of the pedestal 16 by a hinge 50 and may be received within a recess 48 that is defined in the side of the pedestal 16 when not in use. The outrigger support members 44, 46 are preferably deployed to the position that is shown in FIG. 9 and in FIG. 2 primarily when the adjustable lectern 10 has been adjusted to the position shown in FIG. 2 for accommodating a person who will be sitting behind the adjustable lectern 10 while making a presentation. Alternatively, the movement of the outrigger support members 44, 46 could be automated such as by providing an electric motor and transmissions. In this embodiment, the control system that is referred to in greater detail below could be used to control deployment of the outrigger support members 44, 46.

Figure 10:
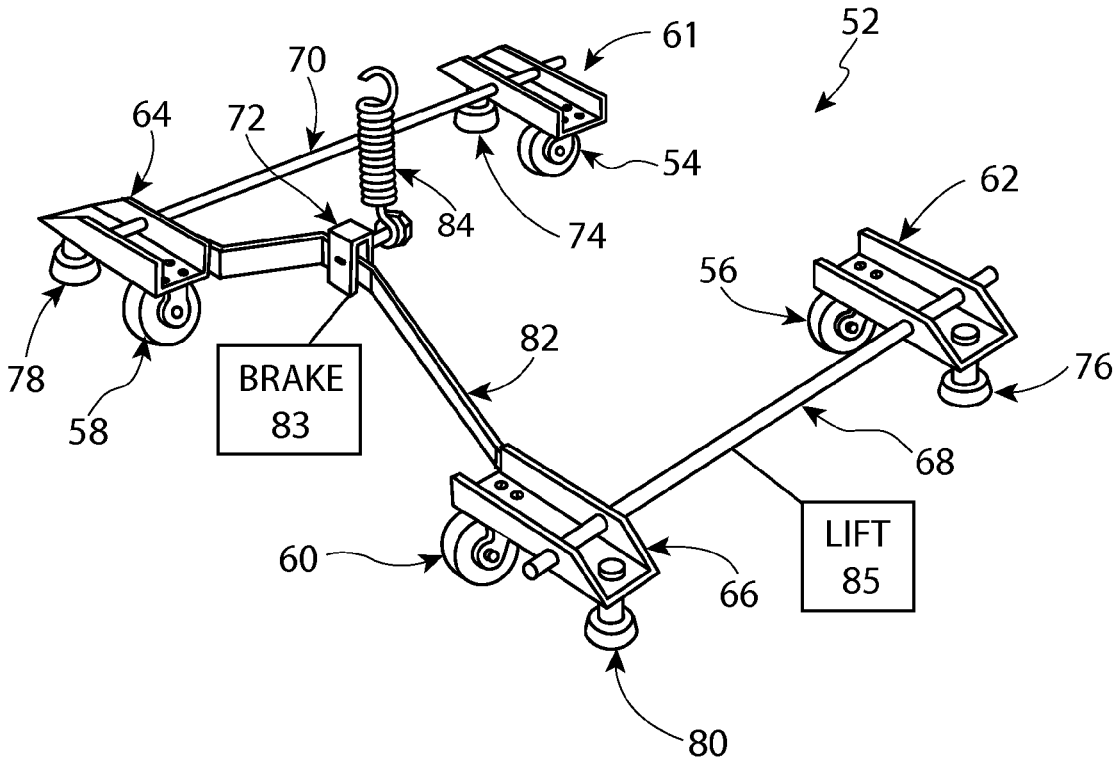
FIG. 10 is a perspective diagrammatical view depicting an optional wheel assembly that may be used with the lectern system that is depicted in FIG. 1.

As FIG. 10 shows, the adjustable lectern 10 may optionally be provided with a wheel assembly 52 for enhancing the mobility of the lectern 10. Wheel assembly 52 preferably includes four wheels 54, 56, 58, 60 that are respectively mounted to wheel frames 61, 62, 64, 66. Support rods 68, 70 respectively couple wheel frame 62 to wheel frame 66 and wheel frame 61 to wheel frame 64, and further have distal ends that are adapted to fit into mounting holes within the pedestal 16. A brake assembly 72 is provided to selectively lock the adjustable lectern 10 in a desired position. In the preferred embodiment, brake assembly 72 is configured so that each of the wheel frames 61, 62, 64, 66 has a brake foot 74, 76, 78, 80 mounted to an underside of the respective wheel frame on an end of the wheel frame that is engaged by the respective support rod 68, 70. A brake control linkage 82 including a brake pedal or actuator 83, a biasing spring 84 and a lift actuator 85 is provided so as to coordinate the downward positioning of the brake feet 74, 76, 78, 81 the brake assembly 72 is actuated.

Figure 11:
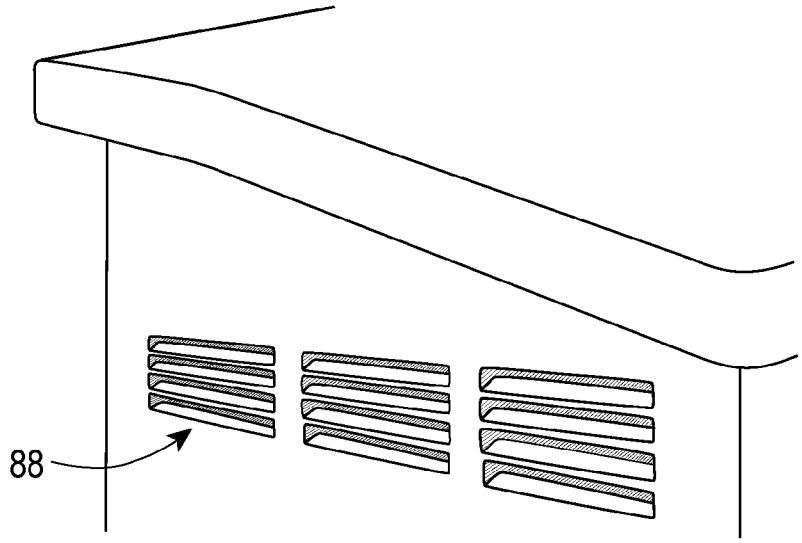
FIG. 11 is a fragmentary view depicting a portion of the lectern system that is constructed according to the preferred embodiment.

The tubular upstanding base member 14 and the tubular upstanding tower member 26 are both preferably substantially hollow. The space within these members 14, 26 is preferably utilized for the positioning of a power control system, electronic equipment, motors and other devices, as will be described in greater detail below. The operation of such equipment may cause significant heat to build up within the space that is defined within members 14, 26, and particularly in the tubular upstanding tower member 26, which is elevated with respect to the tubular upstanding base member 14. In order to dissipate such heat buildup, ventilation openings 88 are preferably defined in one or more of the walls of the tubular upstanding base member 14, as is shown in FIG. 11. It is anticipated that in most configurations the ventilation openings 88 will work adequately to maintain an appropriate temperature within the members 14, 26, however in some instances it may be desirable to further provide a powered ventilation fan in order to draw air through the space that is defined within the members 14, 26.

Figure 12:
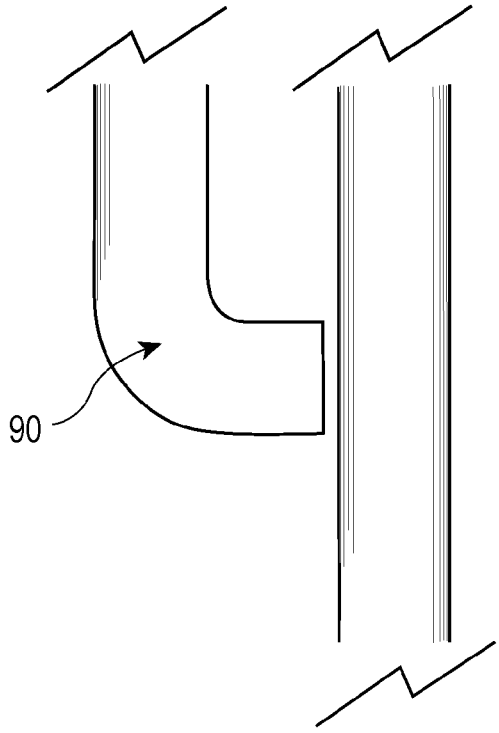
FIG. 12 is a fragmentary view depicting another portion of the lectern system that is shown in FIG. 1.

As FIG. 12 shows, in the preferred embodiment a lowermost edge of the tubular upstanding tower member 26 is preferably provided with an inwardly directed flange 90 in order to prevent fingers, clothes or other objects from being caught between the members 14, 26 when the height of the adjustable lectern 10 is being adjusted.

According to one particularly advantageous feature of the invention, a standardized electronics rackmount 96 is preferably provided at the rear of the tubular upstanding tower member 26, as is best shown in FIG. 5. Rackmount 96 preferably includes a first rail 98 and a second rail 100 that respectively have a plurality of mounting holes 102, 104 defined therein. Rackmount 96 is preferably of an industry standardized (preferably EIA 310-D, IEC 60297 and DIN 41494 SC48D) configuration, and is most preferably an EIA 310-D compliant 19 inch rackmount configuration. Alternatively, an industry standardized 23 inch rack or any other industry standardized rack can be used. A 19-inch rack is a standardized system for mounting various electronic modules in a "stack", or rack that is 19 inches (482.6 mm) wide. Equipment designed to be placed in a rack is typically described as rack-mount, a rack mounted system, a rack mount chassis, subrack, or occasionally, simply shelf.

The mounting rails 98, 100 are preferably configured of two parallel metal strips standing vertically. The strips are preferably made of steel of around 2 mm thickness (the official standard recommends a minimum of 1.9 mm). The strips are each approximately 0.625 inches (15.875 mm) wide, and are separated by a gap of approximately 17.75 inches (450.85 mm), giving an overall rack width of approximately 19 inches (482.6 mm). The strips 98, 100 have holes 102, 104 in them at regular intervals, with both strips 98, 100 matching, so that each hole is part of a horizontal pair with a center-to-center distance of 18.3 inches (464.82 mm). The holes 102, 104 in the strips are preferably arranged vertically in repeating sets of three, with center-to-center separations of 0.5 inch (12.7 mm), 0.625 inch (15.875 mm), 0.625 inch (15.875 mm). The hole pattern thus repeats every 1.75 inches (44.45 mm). Rackmount 96 is accordingly divided into regions, 1.75 inches in height, within which there are three complete hole pairs in a vertically symmetric pattern, the holes being centered 0.25 inch (6.35 mm), 0.875 inch (22.225 mm), and 1.5 inch (38.1 mm) from the top or bottom of the region. Such a region is commonly known as a "RU", for "rack unit", and heights within racks are measured by this unit (which is typically abbreviated as "U"). Rack-mountable equipment is usually designed to occupy some integral number of U. For example, an oscilloscope might be 4 U high, and rack-mountable computers are most often 2 U or 1 U high.

The mounting holes 102, 104 may be tapped to receive a particular type of threaded bolt or screw, or may be provided as plain round or square holes that are compatible with alternative mounting fasteners.

Rack-mountable electronic or other equipment may be mounted to the rear of the tubular upstanding base member 14 by using the rackmount 96 so that the equipment is cantilevered into the hollow interior 106 of the base member 14. For heavier equipment, a second pair of mounting rails may be provided at the back of the equipment.

Figure 13:
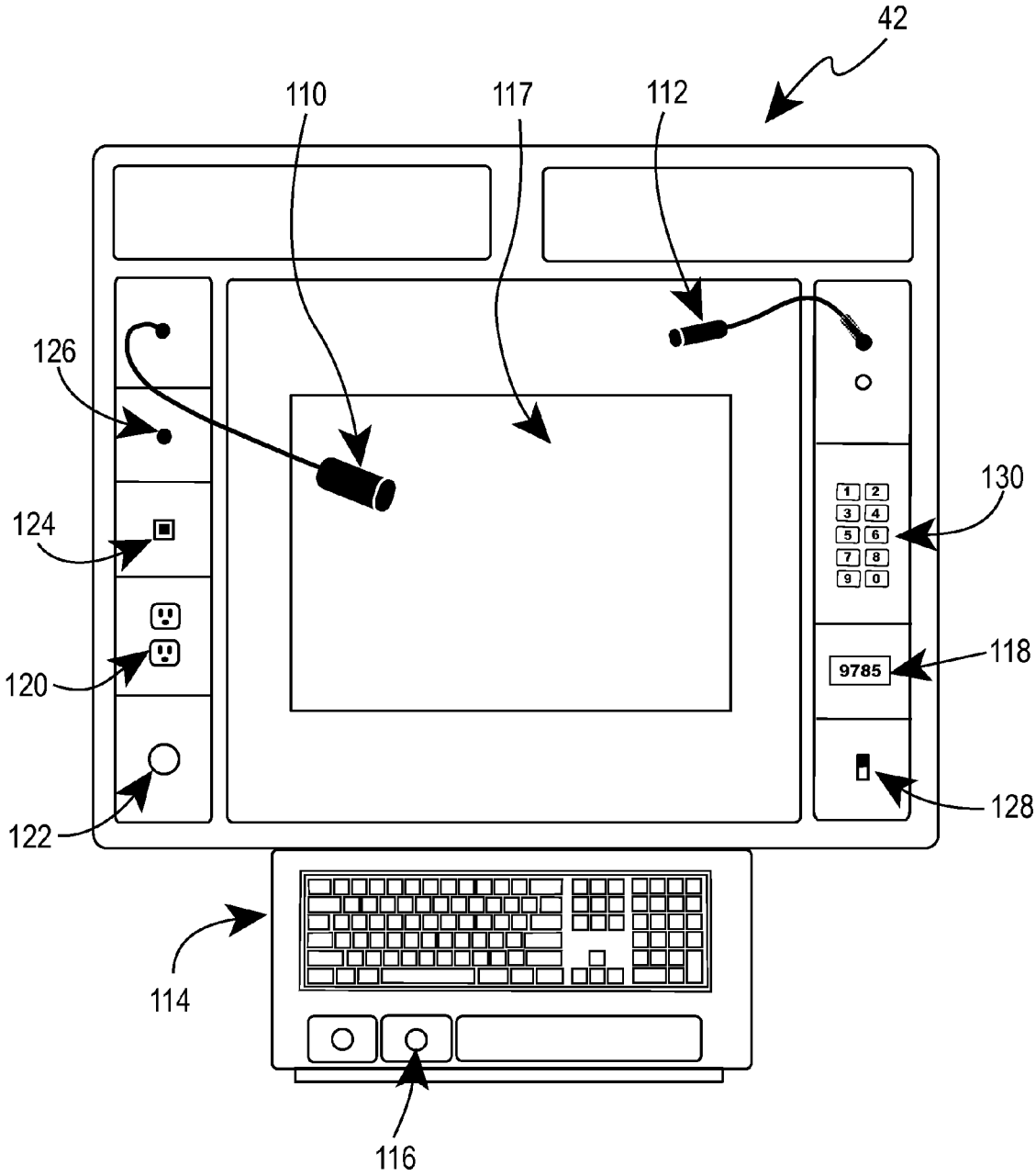
FIG. 13 is a perspective view depicting a work platform on the lectern system that is shown in FIG. 1.

Referring now to FIG. 13, the preferred embodiment of the work platform 42 includes a reading lamp 110, an adjustable microphone 112, and a keyboard 114 that is extendable rearwardly toward the person who is making the presentation. Keyboard 114 preferably includes a pointing device 116 such as a touchpad or trackball. Work platform 42 may further include a clockwork timer 118 that the person who is making the presentation may utilize to determine how long his or her presentation is taking, or how much time remains in his or her allotted presentation time. Work platform 42 further preferably includes a flat screen monitor 117 that is preferably of a touchscreen configuration, a power receptacle 120, a control switch 122 for actuating vertical adjustment of the work platform 42, a network connector 124, a projector screen control 126, a room lighting control 128 and a location 130 that is reserved for other components that a customer may desire to install.

Figure 14:
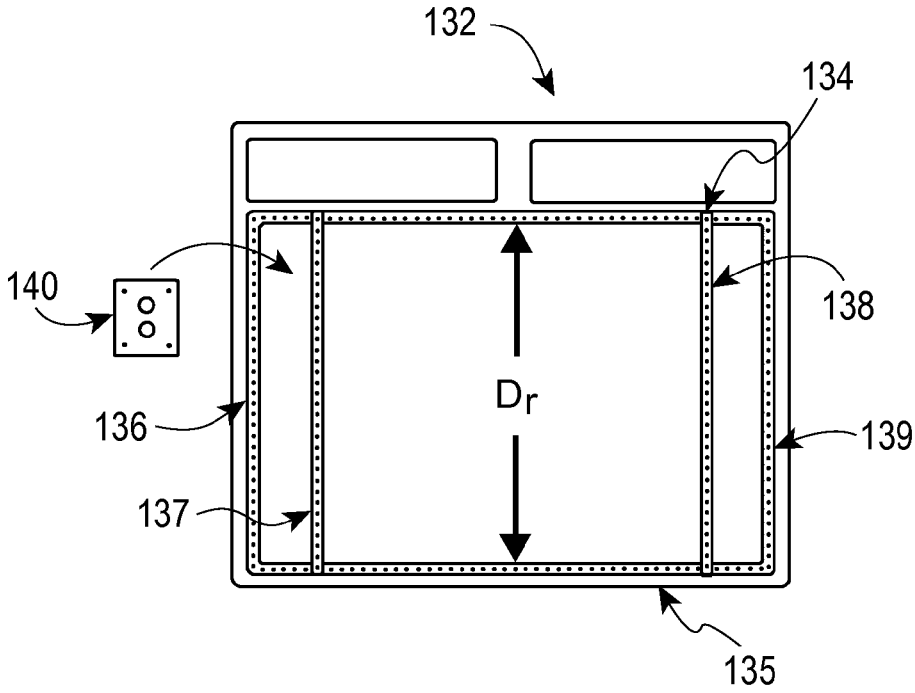
FIG. 14 is a diagrammatical depiction of a preferred construction of the work platform that is shown in FIG. 11.

As FIG. 14 shows, work platform 42 is also preferably configured in a rackmount configuration so that standardized rackmount components may be integrated together as part of a user interface system that is provided on the work platform 42. A frame of the work platform 42 is preferably provided with an industry-standard rackmount 132 having mounting rails 134, 135 that are preferably positioned a distance $D_r$ apart adjacent to upper and lower ends of the inclined work platform 42. The upper surface of the work platform 42 is further segmented into areas that facilitate installation of modular rack mountable components by a modular custom panel system such as the UCP Series Modular Custom Panel System that is commercially available from Middle Atlantic Products, Inc. of Fairfield N.J. Such a system preferably includes a plurality of frame rails 136, 137, 138, 139 to which modular panels 140 may be mounted. In the preferred embodiment, work platform 42 is segmented using such a system into a left side portion that is defined between the mounting rails 136, 137; a central portion that is defined between mounting rails 137, 138; and a right side portion that is defined between mounting rails 138, 139. The mounting rails 134, 135 of the rackmount are preferably in the EIA 310-D compliant 19 inch ($D_r$ being 19 inches) rackmount configuration that is described above, but could be alternatively configured in any other industry recognize configuration, such as a 23 inch rackmount configuration.

In the preferred embodiment of the invention, the center panel portion that is defined between and secured to the mounting rails 137, 138 a flat screen monitor that preferably although not necessarily has touchscreen capability.

Figure 15:
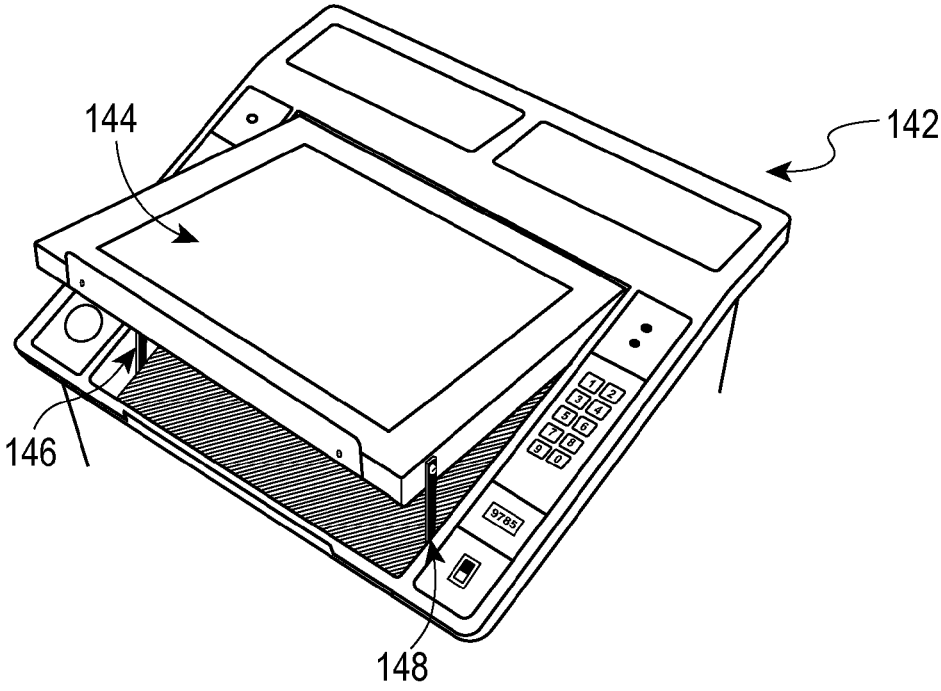
FIG. 15 is a perspective view showing an alternative construction of the work platform.
Figure 20:
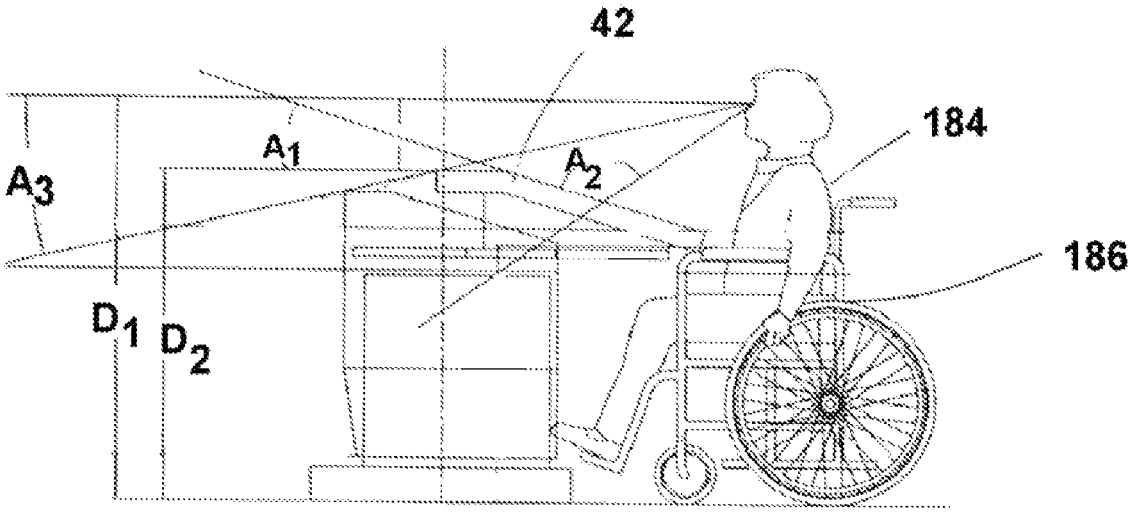
FIG. 20 is a diagrammatical depiction showing a preferred orientation and dimensions of the lectern system that is constructed according to the preferred embodiment when being used by a person who is sitting in a wheelchair.

The upper surface of the work platform 42 is preferably relatively flat and substantially resides within a plane that is angled with respect to a horizontal plane at an angle A1, shown schematically in FIG. 20, which is preferably within a range of about 10° to about 35°. More preferably, the upper surface of the work platform 42 is angled with respect to the horizontal plane within a range of about 15° to about 30°, and most preferably at an angle of about 22.5°. In the preferred embodiment, although the height and the front to rear positioning of the work platform 42 may be adjusted, the angle A1 of the upper surface of the work platform 42 preferably remains constant. However, in the embodiment of the invention that is depicted in FIG. 15, a work platform 142 that is otherwise identical to the work platform 42 described above is provided with a center work platform surface 144 that is hingedly mounted to a forward portion of the work platform 142 so that it may be propped up into a substantially horizontal orientation by means of a pair of support rods 146, 148. It is not anticipated that the work platform 142 will be adjusted to the horizontal position shown in FIG. 15 when a person is making a presentation from either a standing or seated position. The utility of the horizontal position is mainly for supporting a device such as a slide projector, overhead projector or video projector when the need so arises.

Figure 16:
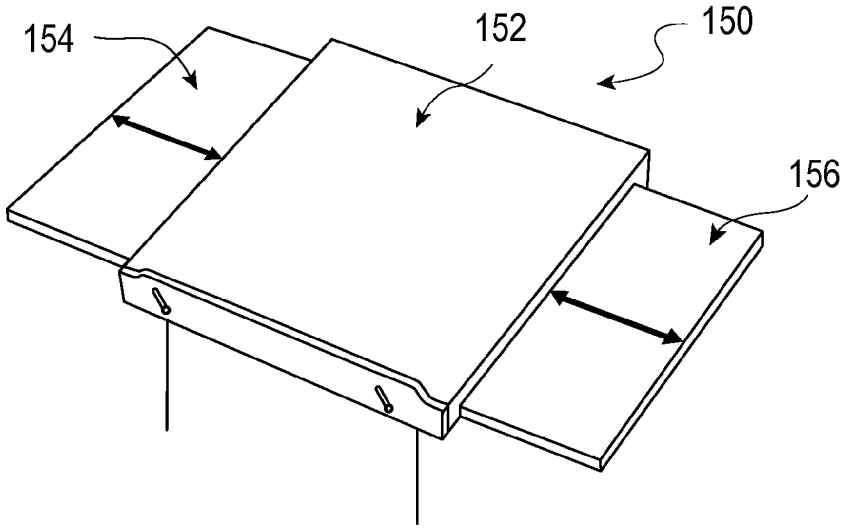
FIG. 16 is a perspective view showing yet another alternative construction of the work platform.

A work platform 150 that is constructed according to a third embodiment of the invention is diagrammatically shown in FIG. 16. In this embodiment, the work platform 150 includes a central platform 152 as well as a pair of laterally extendable side platforms 154, 156 that may be extended linearly outwardly to increase the effective surface area of the work platform 150. When not in use, the side platforms 154, 156 are stored within recesses that are defined beneath the central platform 152. Alternatively, the embodiment shown in FIG. 16 may be configured so that the side platforms 154, 156 are removable from the work platform 150 so as to minimize interference with components that may be embedded within the work platform 150.

Figure 18:
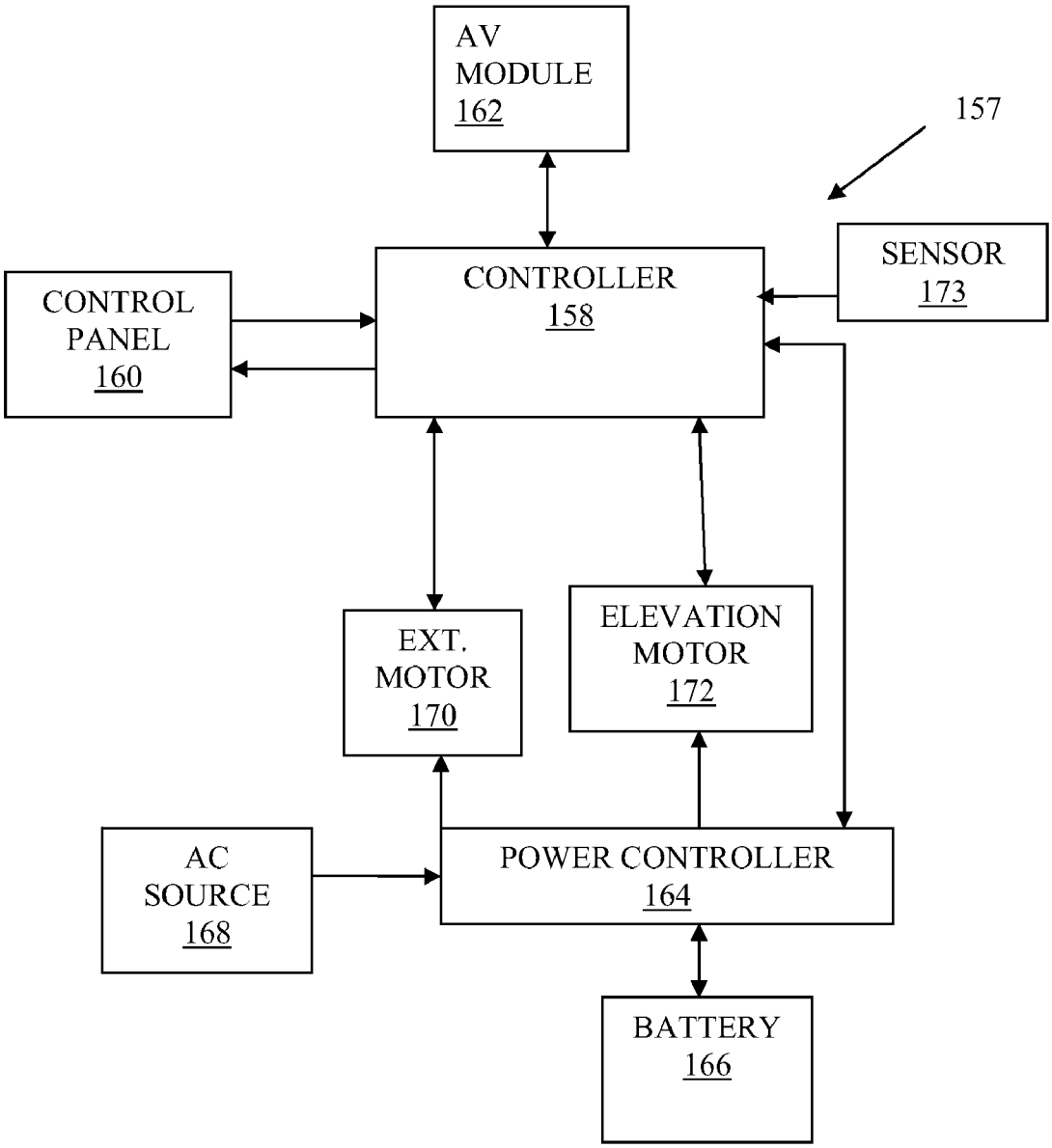
FIG. 18 is a schematic diagram depicting a control system for a lectern system that is constructed according to the preferred embodiment.

FIG. 18 schematically depicts a control system 157 for controlling operation of the adjustable lectern 10. Control system 157 preferably includes a controller or CPU 158 that is in two-way communication with both components on the control panel 160 and with a audiovisual module 162. Controller 158 is also preferably in bilateral communication with a power controller 164, an elevation motor 172 and optionally a work platform extension motor 170.

The power controller 164 is configured to permit the adjustable lectern 10 and the electronic equipment positioned thereon to be operated either while being powered by an alternating current source 168 or by a storage battery 166. The controller 158, power controller 164, battery 166 and motors 170, 172 are all preferably located within the hollow interior 106 of the tubular upstanding base member 14 or within the hollow interior of the tubular upstanding tower member 26. Power controller 164 is preferably adapted to automatically charge the battery 166 when the lectern 10 is connected to the AC power source 168. The power controller 164 may perform the function of a UPS, or a UPS could be separately provided within the frame of the adjustable lectern 10.

Control system 157 also preferably includes a sensor 173 for sensing an unsafe condition during adjustment of the height of the adjustable lectern 10. Sensor 173 sends a signal to the controller 158, which disables the elevation motor 172 in the event of an unsafe condition. In the preferred embodiment, sensor 173 is a current sensor for sensing the current that is being provided to the elevation motor 172. In the event that part of a person's body, clothing or another object restricts the movement of or applies a force that is greater than a predetermined minimum to any moving component of the adjustable lectern 10 while the height and/or horizontal position of the adjustable lectern 10 is being adjusted, the amount of current that is being provided to the elevation motor 172 would be expected to surge. The sensor 173 is configured to be able to detect such a surge and compares the magnitude of the surge to base line current usage of the elevation motor 172 during normal operating conditions. When the deviation between the surge and the base line current usage exceeds a predetermined maximum, the controller 158 will automatically stop or reverse the elevation motor 172. Although this system has been described in conjunction with the motorized height adjustment mechanism, it will be appreciated that a similar sensor and control arrangement could be incorporated into a motorized system for forward and rearward adjustment of the work platform 42 using the work platform extension motor 170 in those embodiments of the invention in which forward and rearward adjustment of the work platform 42 is effected using a motorized adjustment mechanism.

The control system 157 may further be configured with a memory feature so that individualized coordinate positioning of the vertical and/or horizontal adjustment of the position of the work platform 42 could be programmed. For example, during a conference at which multiple individuals are making presentations and wherein some of those individuals will be returning to the lectern 10 at later times, each individual may press a switch or button on the work platform 42 so that the vertical and/or horizontal positioning of the adjustable lectern 10 will be remembered. The flat-panel display may be utilized to display a code when a position is entered into memory that the user may later enter in order to instruct the adjustable lectern 10 via the control system 157 to return to the proper vertical and/or horizontal position.

The audiovisual module 162 preferably includes rackmount electronic components 108 that are mounted to the rackmount 96 as is shown in FIG. 1. The electronic components 108 may include a computer, a VCR or DVR, a DVD player, a power strip, a cooling fan or any other standardized rackmount component that might have utility for use in making audience presentations. It may include audio and/or video recording, storage or amplification equipment as well as equipment such as audio speakers, which may be provided as part of a complete public address system. It may also include a computer for receiving, storing, processing and presenting digital audio/video content, which may be controlled by a person who is making a presentation by means of the keyboard 114 that is shown in FIG. 11 and a flat display screen 117 that is provided in the central portion of the work platform 42.

Figure 17:
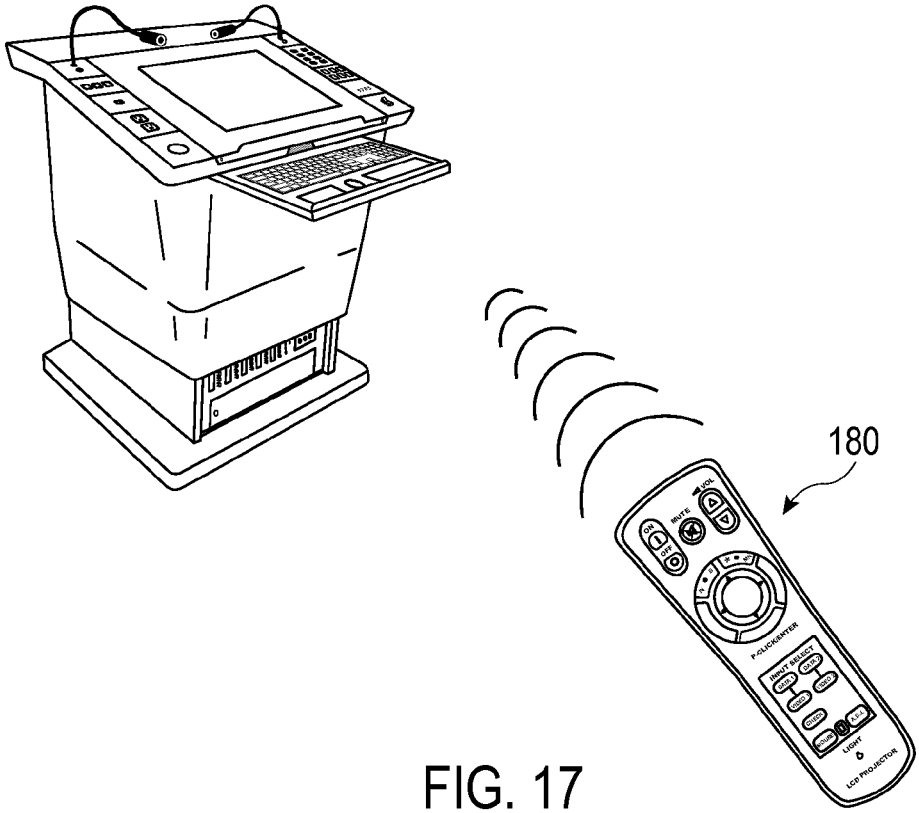
FIG. 17 is a diagrammatical depiction of one functionality of a lectern system that is constructed according to the preferred embodiment.
Figure 19:
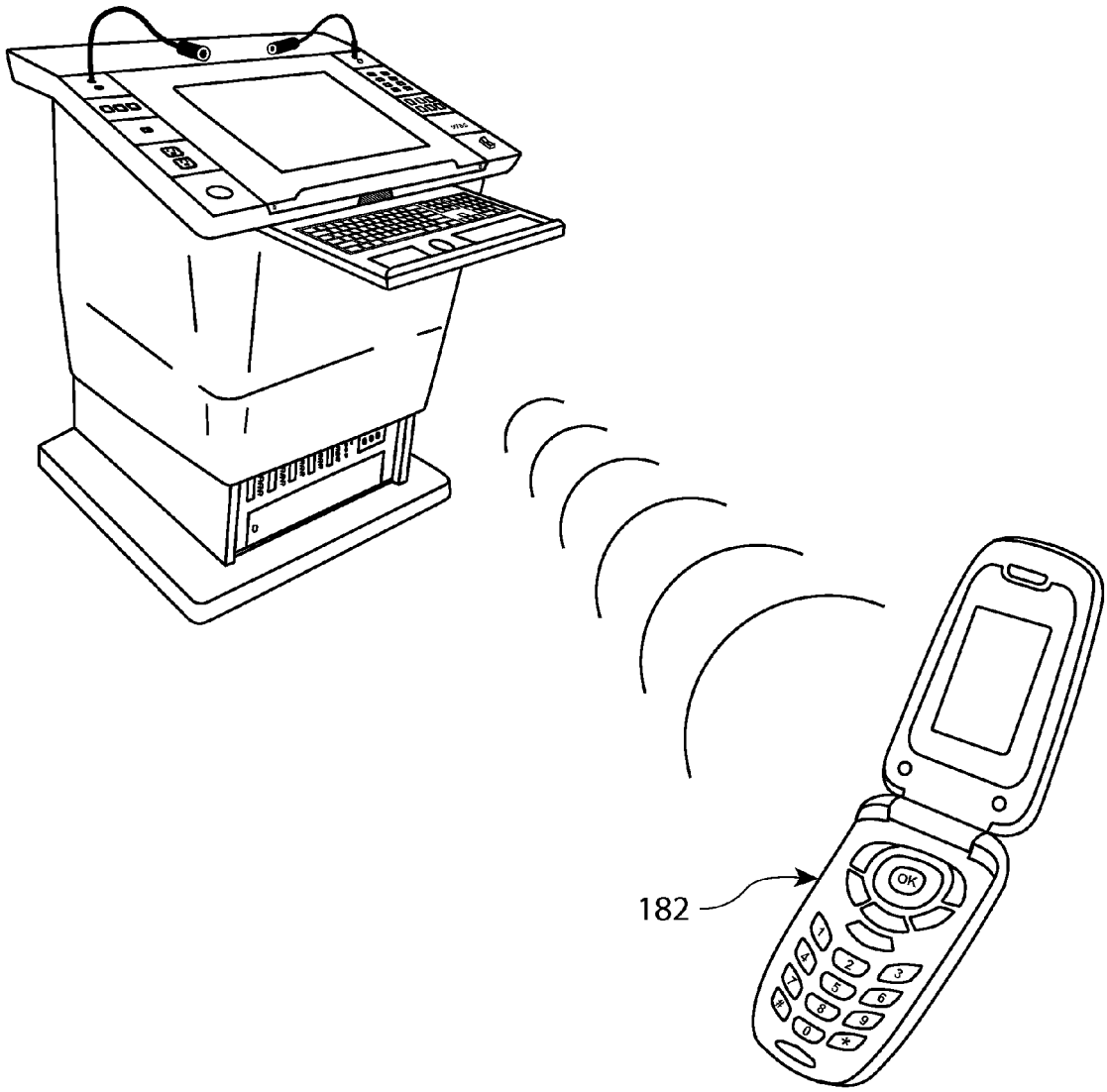
FIG. 19 is a diagrammatical depiction of another functionality of the lectern system that is constructed according to the preferred embodiment.

As a shown in FIGS. 17 and 19, respectively, the control system 157 may be configured for wireless communications with a remote control unit 180 and or a wireless communications device such as a cell phone 182. The wireless communication may be via an infrared link, Bluetooth, WiFi, RF, laser or any standard or nonstandard wireless communication protocol. The control system 157 may also be connected to the Internet, either via a wireless link or a hardwire cable.

FIG. 20 depicts the adjustable lectern 10 when it has been adjusted to the ideal position for accommodating a person 184 who is making a presentation while seated in a wheelchair 186. The person 184 is estimated to be seated so that his or her eye level is about a distance D2 that is about 47 inches from the ground.

As has been discussed above, the upper surface of the work platform 42 is preferably positioned at an angle A1 with respect to a horizontal plane. The upper surface of the work platform 42 further defines an angle A2 with respect to a line of sight for the user 184 to a central location on the work platform 42. The angle A2 is preferably substantially within a range of about 110° to about 150°, is more preferably within a range of about 120° to about 140° and is most preferably at about 128°.

The uppermost surface of the work platform 42 in the preferred embodiment is preferably positioned at a height D1 above the ground that is within a range of about 28 inches to about 45 inches and that is more preferably within range is between about 35 inches and about 40 inches. Most preferably, the height D1 is about 38.8 inches.

A line of sight from the user 184 to the distal, upper end of the work platform 42 is oriented with respect to a horizontal plane at an angle A3 that is preferably between about 5° and about 20°, and is more preferably within a range of about 10° and about 15°. Most preferably, angle A3 is about 13°.

The adjustable lectern 10 preferably complies with all ADA (Americans with Disabilities Act) requirements, including a wheelchair height access of 28 inches and a width of 36 inches.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An adjustable lectern, comprising:

a base portion, said base portion comprising an tubular upstanding base member having at least a front base surface, a first side base surface and a second side base surface;

a tower portion, said tower portion comprising a tubular upstanding base member, said mounted in a telescoping arrangement with respect to said tubular upstanding base member, said tubular upstanding tower member having at least a front tower surface, a first side tower surface and a second side tower surface;

at least one bearing for enabling relative movement between said base portion and said tower portion;

motorized drive means for adjusting a vertical position of said tower portion relative to said base portion;

a work platform, said work platform being positioned at an upper end of said tower portion; and wherein said base portion, said tower portion, said bearing and said motorized drive means are configured so as to permit a vertical adjustment of said work platform that is sufficient to accommodate both users standing behind said adjustable lectern and users who are sitting behind said adjustable lectern in a wheelchair.

2. An adjustable lectern according to claim 1, wherein said base portion comprises at least one outrigger support member for stabilizing said lectern against tipping.

3. An adjustable lectern according to claim 2, wherein said movable outrigger support member is movable between a first retracted position adjacent to said base portion and a second extended position.

4. An adjustable lectern according to claim 1, wherein one of said base portion and said tower portion has an electronics rackmount provided thereon that is of an EIA 310-D compliant configuration.

5. An adjustable lectern according to claim 4, wherein said electronics rackmount is provided adjacent to an open rear surface of said tubular upstanding base member, whereby an electronic component that is mounted to said electronics rackmount will extend into a hollow interior of said upstanding tubular base member.

6. An adjustable lectern according to claim 1, wherein said work platform is horizontally adjustable with respect to said tower portion.

7. An adjustable lectern according to claim 1, wherein said work platform has an electronics rackmount provided thereon that is of an EIA 310-D compliant configuration.

8. An adjustable lectern according to claim 1, wherein said tower portion further comprises a rear tower surface, whereby said tower portion is configured as a closed tubular member.

9. An adjustable lectern according to claim 1, further comprising a power control system that is configured to permit operation of said lectern when said lectern is not connected to AC power, said power control system comprising a battery that is mounted within one of said upstanding tubular base member and said upstanding tubular tower member.

10. An adjustable lectern according to claim 1, further comprising an electronic control system for controlling operation of said lectern.

11. An adjustable lectern according to claim 10, wherein said electronic control system comprises a safety stop system for disabling operation of said motorized drive means when an unsafe condition is sensed.

12. An adjustable lectern according to claim 11, wherein said safety stop system comprises a current sensor for sensing electrical cunent input to said motorized drive means.

13. An adjustable lectern according to claim 1, wherein said work platform has an upper surface that is tilted with respect to a horizontal plane at an angle that is substantially within a range of about 10° to about 35°.

14. An adjustable lectern according to claim 1, wherein said base tubular member is fabricated from a sheet-metal material.

15. An adjustable lectern according to claim 1, wherein said tower tubular member is fabricated from a sheet-metal material.

16. An adjustable lectern according to claim 1, wherein at least one of said tubular base member, tubular tower member and work platform has an electronics rackmount provided thereon that is of an EIA 310-D compliant configuration, and further comprising at least one electronic component mounted to said electronics rackmount.

17. An adjustable lectern according to claim 16, wherein said at least one electronic component comprises an audiovisual presentation system.

18. An adjustable lectern according to claim 17, wherein said audiovisual presentation system comprises at least one wireless communications module.

19. An adjustable lectern, comprising:

a base portion, said base portion comprising an tubular upstanding base member having a front base surface, a first side base surface and a second side base surface, said front base surface, said first side base surface and said second side base surface all being defined by a first single, unitary piece of material, said base member further having an opening defined in a rear side thereof, and wherein an electronics rackmount that is of an EIA 310-D compliant configuration is provided adjacent to said opening;

a tower portion, said tower portion comprising a tubular upstanding tower member that is mounted in a telescoping affangement with respect to said tubular upstanding base member, said tubular upstanding tower member having at least a front tower surface, a first side tower surface, a rear tower surface and a second side tower surface, said front tower surface, said first side tower surface, said rear tower surface and said second side tower surface all being defined by a second single, unitary piece of material;

an electronic component mounted to said electronics rackmount, said electronic rackmount, said eletronic component extending into a hollow space within said tubular upstanding base member;

a height adjustment drive system for adjusting a vertical position of said tower position relative to said base portion;

a work platform, said work platform being positioned at an upper end of said tower portion; and wherein said base portion, said tower portion and said height adjustment drive system are configured so as to permit a vertical adjustment of said work platform that is sufficient to accommodate both users standing behind said adjustable lectern and users who are sitting behind said adjustable lectern in a wheelchair.

20. An adjustable lectern according to claim 19, wherein said electronic component comprises a cooling fan.

21. An adjustable lectern according to claim 19, wherein said electronic component comprises a power strip.

* * * * *

UNITED STATES PATENT AND TRADEMARK OFFICE

CERTIFICATE OF CORRECTION

PATENT NO. : 7,439,694 B2
APPLICATION NO. : 11/465766
DATED : October 21, 2008
INVENTOR(S) : Richard B. Atlas et al.

It is certified that error appears in the above-identified patent and that said Letters Patent is hereby corrected as shown below:

Col. 11, Line 36,
Claim 1, Line 7: "upstanding base member, said mounted in a telescoping" should read "upstanding tower member that is mounted in a telescoping"

Col. 12, Line 28,
Claim 12: "cunent" should read "current"

Col. 12, Line 64,
Claim 19, Line 14: "affangement" should read "arrangement"

Signed and Sealed this

Second Day of December, 2008

JON W. DUDAS
*Director of the United States Patent and Trademark Office*